US006299406B1

(12) United States Patent
Yu et al.

(10) Patent No.: US 6,299,406 B1
(45) Date of Patent: Oct. 9, 2001

(54) HIGH EFFICIENCY AND LOW NOISE FUEL PUMP IMPELLER

(75) Inventors: DeQuan Yu, Ann Arbor; Ronald Luce Verkleeren, Dearborn, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/523,818

(22) Filed: Mar. 13, 2000

(51) Int. Cl.[7] ..... F04D 5/00
(52) U.S. Cl. ..... 415/55.1
(58) Field of Search ..... 415/55.1, 55.2, 415/55.3, 55.4, 55.5

(56) References Cited

U.S. PATENT DOCUMENTS

| | | | | |
|---|---|---|---|---|
| 2,220,538 | | 11/1940 | Neibert . | |
| 3,359,908 | * | 12/1967 | Toma | 415/203 |
| 4,141,674 | * | 2/1979 | Schonwald | 415/55.1 X |
| 4,834,612 | * | 5/1989 | Lahn et al. | 415/55.1 X |
| 5,098,258 | * | 3/1992 | Barnetche-Gonzalez | 415/55.2 X |
| 5,123,809 | * | 6/1992 | Ito | 415/55.1 |
| 5,163,810 | * | 11/1992 | Smith | 415/55.1 |
| 5,209,630 | | 5/1993 | Roth . | |
| 5,265,997 | * | 11/1993 | Tuckey | 415/55.1 |
| 5,273,394 | | 12/1993 | Samuel . | |
| 5,299,908 | | 4/1994 | Robbie . | |
| 5,490,761 | * | 2/1996 | Hablanian | 415/55.5 X |
| 5,498,124 | | 3/1996 | Ito et al. . | |
| 5,498,125 | * | 3/1996 | Hablanian | 415/55.1 X |
| 5,807,068 | * | 9/1998 | Dobler et al. | 415/55.1 |
| 6,113,363 | * | 9/2000 | Talaski | 415/55.1 X |

FOREIGN PATENT DOCUMENTS

| | | | | |
|---|---|---|---|---|
| 3-81596-A | * | 4/1991 | (JP) | 415/55.1 |
| 6-159282-A | * | 6/1994 | (JP) | 415/55.1 |

* cited by examiner

*Primary Examiner*—John E. Ryznic
(74) *Attorney, Agent, or Firm*—Mark L. Mollon

(57) ABSTRACT

A semi-open staggered vane impeller for use in an automotive fuel pump. Each vane has a cover-side vane tooth and a body-side vane tooth extending from a central vane groove. Each vane is coupled to the next adjacent vane by a rib that runs substantially parallel to the vane groove. In addition, each vane has a phase difference between its cover-side vane tooth and body-side vane tooth that is a function of the length of the vane groove.

19 Claims, 3 Drawing Sheets

| Pressure (KPa) | Speed (RPM) | Invention | (Prior Art) |
|---|---|---|---|
| 200 | 4000 | 39.0 | 34.1 |
| 284 | 5500 | 76.3 | 66.6 |

| Pressure (KPa) | Speed (RPM) | Invention | (Prior Art) |
|---|---|---|---|
| 200 | 4000 | 0.0212 | 0.0219 |
| 284 | 5500 | 0.0324 | 0.0332 |

| Pressure (KPa) | Speed (RPM) | Invention | (Prior Art) |
|---|---|---|---|
| 200 | 4000 | 24.4% | 20.7% |
| 284 | 5500 | 32.3% | 27.5% |

HIGH EFFICIENCY AND LOW NOISE FUEL PUMP IMPELLER

TECHNICAL FIELD

The present invention relates to vehicle fuel pump and more particularly to a regenerative fuel pump impeller for use in an automobile.

BACKGROUND

Conventional tank-mounted automotive fuel pumps typically have a rotary-pumping element, such as an impeller that is encased within a pump housing. Typical impellers have a plurality of vanes and ribs formed around their peripheries and rotation of the impellers draw fuel into a pumping chamber located within the pump housing. The rotary pumping action of the impeller vanes and ribs causes fuel to exit the housing at high-pressure. Regenerative fuel pumps are commonly used to pump fuel in automotive engines because they have a more constant discharge pressure than, for example, positive displacement pumps. In addition, regenerative pumps typically cost less and generate less audible noise during operation than other known pumps.

Pump efficiency and noise are two problems commonly associated with fuel pump technology, and specifically associated with impeller technology. Many solutions have been proposed to improve the pump technology. For example, regenerative open vane (line teeth) impeller fuel pumps have achieved greater pumping efficiency over the prior generation non-open vane fuel pumps. However, these improvements also generated relatively high vane teeth order pressure pulsation and relatively high noise.

In an effort to solve these problems, traditional methods introduced a two-stage pump to create two different phased pressure-pumping actions. These two-stage pumps provided decreased noise and decreased overall pulsation. However, use of these two-stage pumps is complicated and relatively expensive to implement.

In another effort to solve the pulsation and noise problem discussed above, a staggered vane impeller pump has also been utilized. While this staggered vane impeller pump provided lower pulsation and noise, it sacrificed pump efficiency, and therefore was not an ideal solution.

SUMMARY OF THE INVENTION

It is therefore an object of the present invention to introduce a new impeller design that achieves both increased pump efficiency and lower noise.

In accordance with this and other objects of the present invention, a "semi-open staggered vane" impeller for a fuel pump is provided. The fuel pump impeller includes a plurality of vanes that are spaced about and extend radially outward from a central hub of the impeller. Each of the plurality of vanes has a vane groove that is coplanar with the top and bottom surfaces of the impeller. Each of the vanes also has a pair of vane teeth extending at an angle from each respective end of the vane groove. The vane groove also functions to prevent back flow leakage in the impeller. In addition, each of the vanes is connected to the next adjacent vane by a central rib. The length of the vane groove (length running coplanar with the impeller) may vary from zero, corresponding to the point where the vane teeth are in phase with respect to each other, to a maximum length equal to the length of the central rib, where the phase difference between the vane teeth are substantially out of phase with respect to each other. The phase difference of the vane teeth affects teeth order pressure pulsation and noise, where the lowest teeth order pressure pulsation and noise is achieved when the length of the vane groove is maximized.

Other objects and advantages of the present invention will become apparent upon considering the following detailed description and appended claims, and upon reference to the accompanying drawings.

DESCRIPTION OF THE PREFERRED EMBODIMENT(S)

Figure 1:
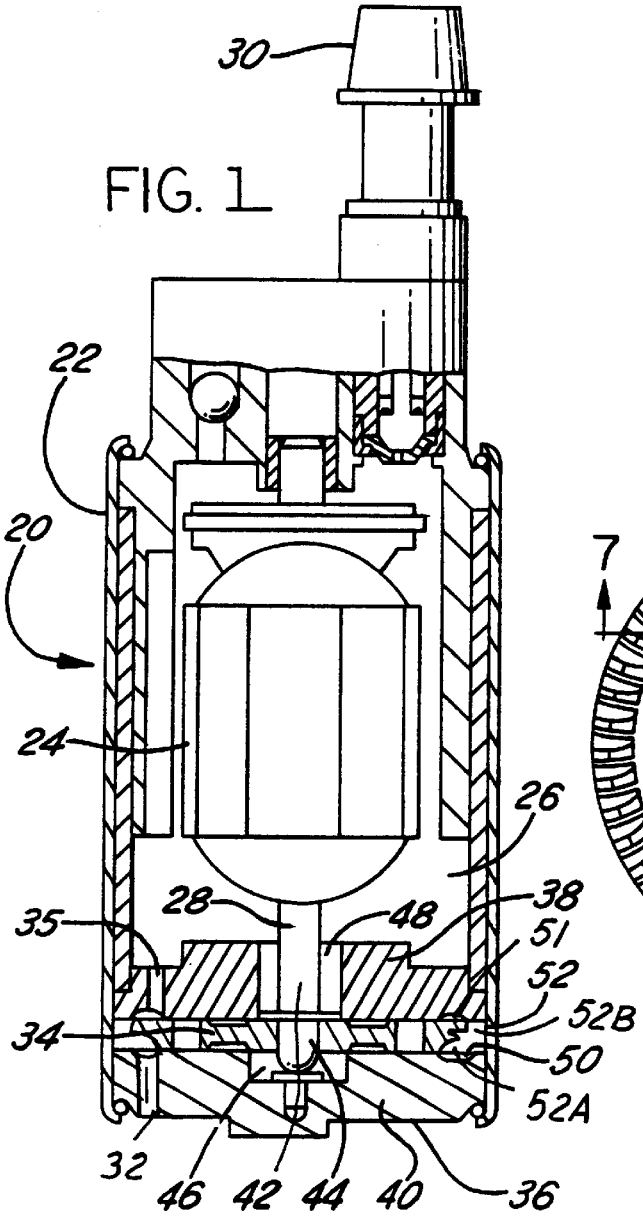
FIG. 1 is a cross-sectional side view of a fuel pump having an impeller according to a preferred embodiment of the present invention.
Figure 3:
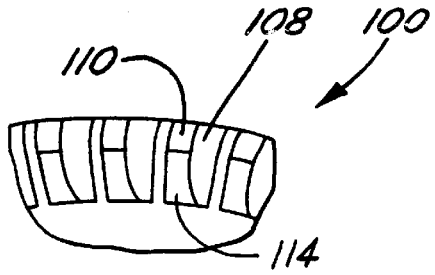
FIG. 3 is an enlarged side view of a portion of the impeller contained within the circle 3 on FIG. 2.
Figure 2:
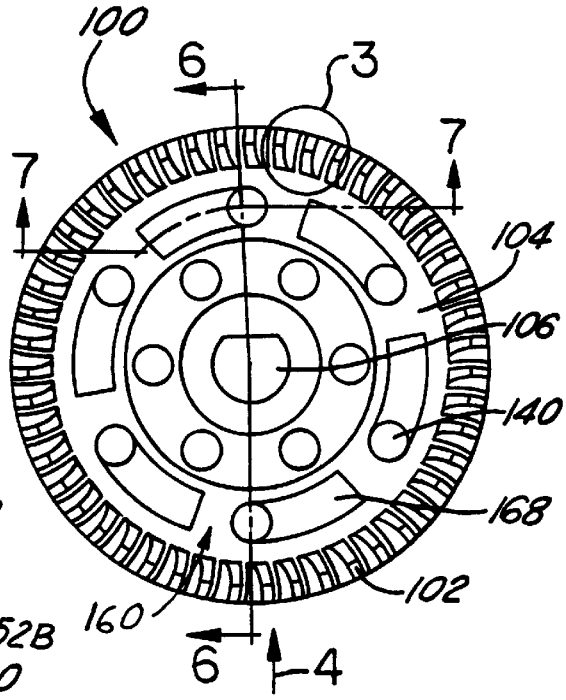
FIG. 2 is a side elevation view of the cover side of an impeller according to a preferred embodiment of the invention.
Figure 4:
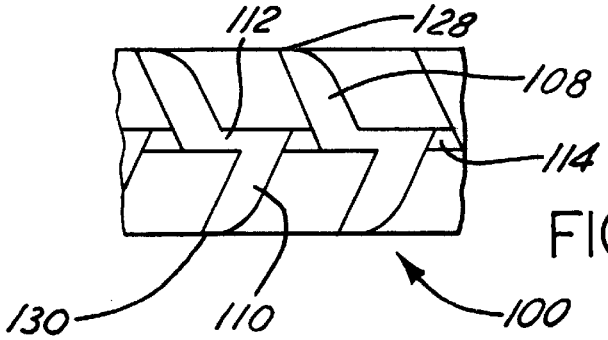
FIG. 4 is a top view FIG. 2 in the direction of the arrow 4.
Figure 5:
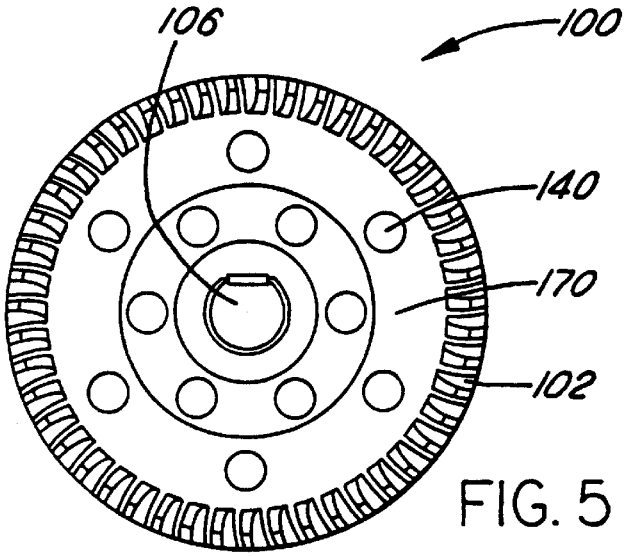
FIG. 5 is a side elevation view of the body side of the impeller according to a preferred embodiment of the present invention.
Figure 6:
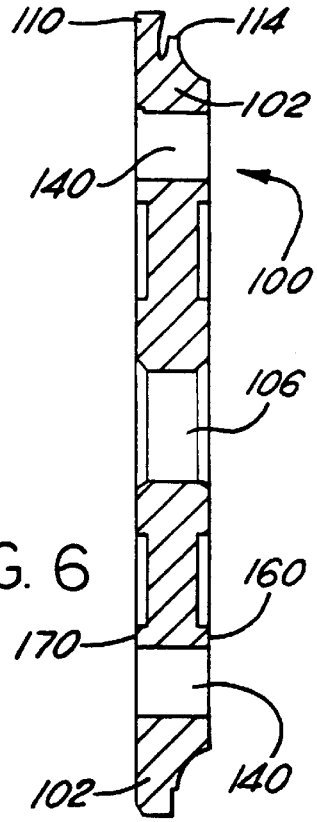
FIG. 6 is a cross-sectional view of an impeller taken along line 6—6 of FIG. 2.
Figure 7:
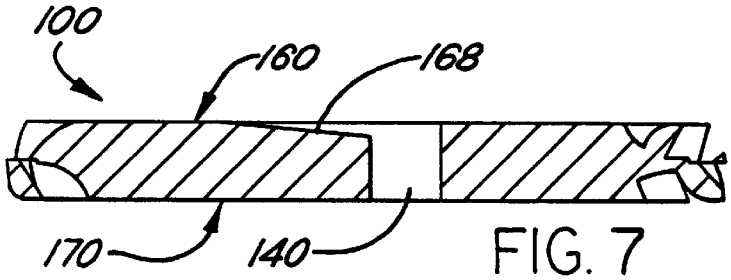
FIG. 7 is a cross-sectional view of an impeller taken along line 7—7 of FIG. 2.

Referring now to FIG. 1, a cross-sectional view of a fuel pump 20 in accordance with the present invention is illustrated. The fuel pump 20 is preferably for use in a motor vehicle, but may be used in a variety of applications including non-automotive.

The fuel pump 20 includes a housing 22 for retaining a motor 24, which is mounted within a motor space 26. The motor 24 is preferably an electric motor, but may be a variety of other motors. The motor 24 has a shaft 28 extending therefrom through a fuel pump outlet 30 and to a fuel inlet 32. The shaft 28 also has a disk-shaped impeller 34 slidingly engaged thereon. The impeller 34 is encased within a pump housing 36, which is comprised of a pump body 38 and a pump cover 40. The impeller 34 includes a central axis 42 that is coincident with the axis of the motor shaft 28. The shaft 28 passes through a shaft opening 44 formed in the center of the impeller 34 and into a recess 46 formed in the pump cover 40.

As seen in FIG. 1, the shaft 28 is journalled within a bearing 48. The pump body 38 has a flow channel 51 formed therein. The pump cover 40 has a flow channel 50 formed therein. The flow channel 50 leads from a pumping chamber 52A and is located along the periphery of the impeller 34. The flow channel 51 leads from a pumping chamber 52B and is located on the periphery of the impeller and adjacent to the pumping chamber 52A. In operation, fuel is drawn from the fuel tank (not shown), in which a fuel pump 20 may be mounted, through the fuel inlet 32, in the pump cover 40 and into the flow channel 50, 51 by the rotary pumping action of the impeller 34. High-pressure fuel is then discharged through the high-pressure outlet 35 to the motor space 26. The fuel is then passed to the fuel pump outlet 30 and in doing so cools the motor 24.

Turning now to FIGS. 2 through 8, the impeller 100 according to the present invention is shown. The impeller 100 has a plurality of vanes 102 that extend from a central hub 104 and terminate at the impeller periphery. The central hub 104 has a shaft opening 106 through which the shaft (not shown) of the motor (not shown) may pass through to rotate the impeller 100 around its shaft opening 106. The impeller 100 has a plurality of pressure balance holes 140 formed therethrough that function to keep the impeller 100 centered within its housing (not shown) upon the introduction of fuel through the fuel inlet (not shown). The impeller 100 further has a cover side 160, and a body side 170 opposed to one another. The cover side 160 of the impeller 100 has a plurality of ramps 168 for creating a lifting force away from the cover side 160 to balance the weight of the impeller 134 and other potential pressure differences between the two sides of the impeller 100.

Each vane 102 of the impeller 100 has a cover-side vane tooth 108 and a body-side vane tooth 110 extending from a respective vane groove 112. Each of the cover-side vane teeth 108 has a cover-side point 128 located at a position farthest from the vane groove 112 and peripherally terminates at the plane defined by the cover side 160. Each of the body-side vane teeth 110 has a body-side point 130 located at a position farthest from the vane groove 112 and peripherally terminates at the plane defined by the body side 170. Each vane 102 is coupled to adjacent vanes 102 through a rib 114. The rib 114 may be of varying height and varying length. However, in the preferred embodiment it is around 60% of the height of the vane groove 112. The highest efficiency of pumping action of a preferred embodiment of the present invention is achieved when the height of vane groove 112 is equal to the height of the cover-side and body-side vane teeth 108, 110. The length of the central rib 114 may vary as a function of both the length of the vane groove 112 and the height of the central rib 114. The length of the central rib 114 can affect noise and impeller efficiency. In a preferred embodiment, the length of the central rib 114 is equal to the length of the vane groove 112.

Figure 8:
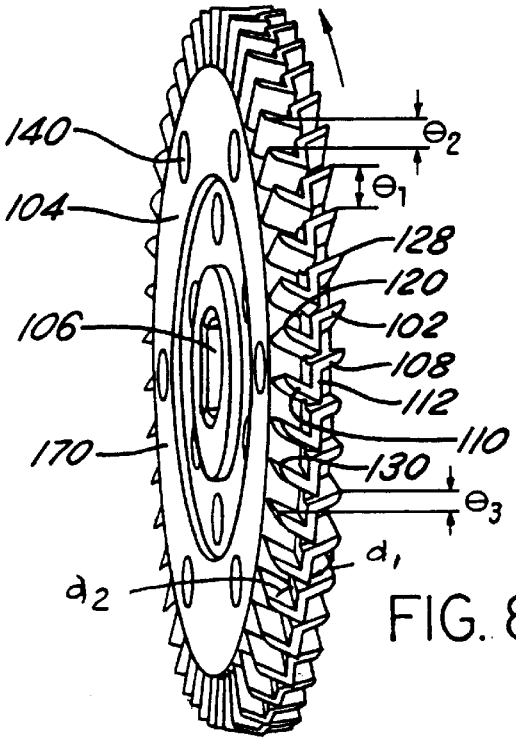
FIG. 8 is a perspective view of an impeller according to a preferred embodiment of the invention.

Referring now to FIG. 8, each vane 102 is uniformly spaced around the periphery of the central hub 104 of the impeller 100. Each cover-side point 128 is similarly spaced equidistant around the periphery of the impeller at a distance T1. Each body-side point 130 is also spaced equidistant around the periphery of the impeller at a distance T2. In addition, each cover-side vane tooth 108 has an angle Δ1 relative to the vane groove 112, and each body-side vane tooth has an angle Δ2 relative to the vane groove 112, such that Δ1+Δ2 is equal to 180 degrees.

In addition, there may be a phase difference T3 between a cover-side point 128 and a body-side point 130 located on each vane 102. This phase difference T3 may vary as a function of the length of the vane groove 112. When the length of the vane groove 112 is 0, the phase difference T3 is 0, which is in phase. As the length of the vane groove 112 increases, T3 gets larger, causing the vane teeth 108, 110 to become out of phase with respect to each other. When the vane groove 112 reaches its maximum length, where the cover-side point 128 is midway between body-side points 130 on adjacent vanes 102 (or T2/2) and where the body-side point 130 is midway between cover-side points 128 on adjacent vanes 102 (or T1/2), the phase difference T3 is maximized. The preferred embodiment of the present invention as shown in FIG. 8 is when the vane groove 112 length is maximized. At this point, the impeller 100 has the lowest teeth order pressure pulsation and noise. However, a variety of alternate configurations may be adapted.

Another factor that affects pump efficiency is the radial depth of the channel 120. The channel 120 is created between vanes 102 of the impeller 100 and between the rib 114 and the pump housing (shown as 36 in FIG. 1). The depth of the channel 120 varies by changing the radial height of the central rib 114 or with the radial height of the vane 102. With the design of the preferred embodiment of the present invention, a deeper channel 120 depth is generally required compared to prior designs, although the depth of the channel 120 will vary according to the pressure of fuel flow through the impeller 100.

Figure 9:
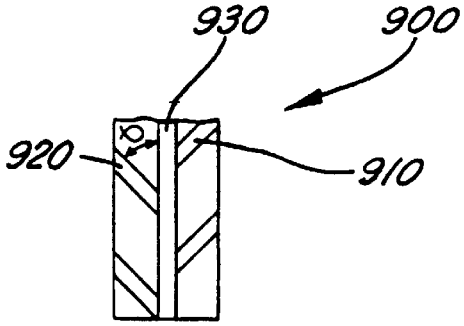
(PRIOR ART) FIG. 9
FIG. 9 is a side view of a staggered vane impeller according to the prior art.

Referring now to FIG. 9, a staggered vane type impeller 900 according to the prior art is depicted. The impeller 900 has a cover-side vane 910 and a body-side vane 920, each has an angle Δ relative to a central rib 930.

Figures 10, 11:
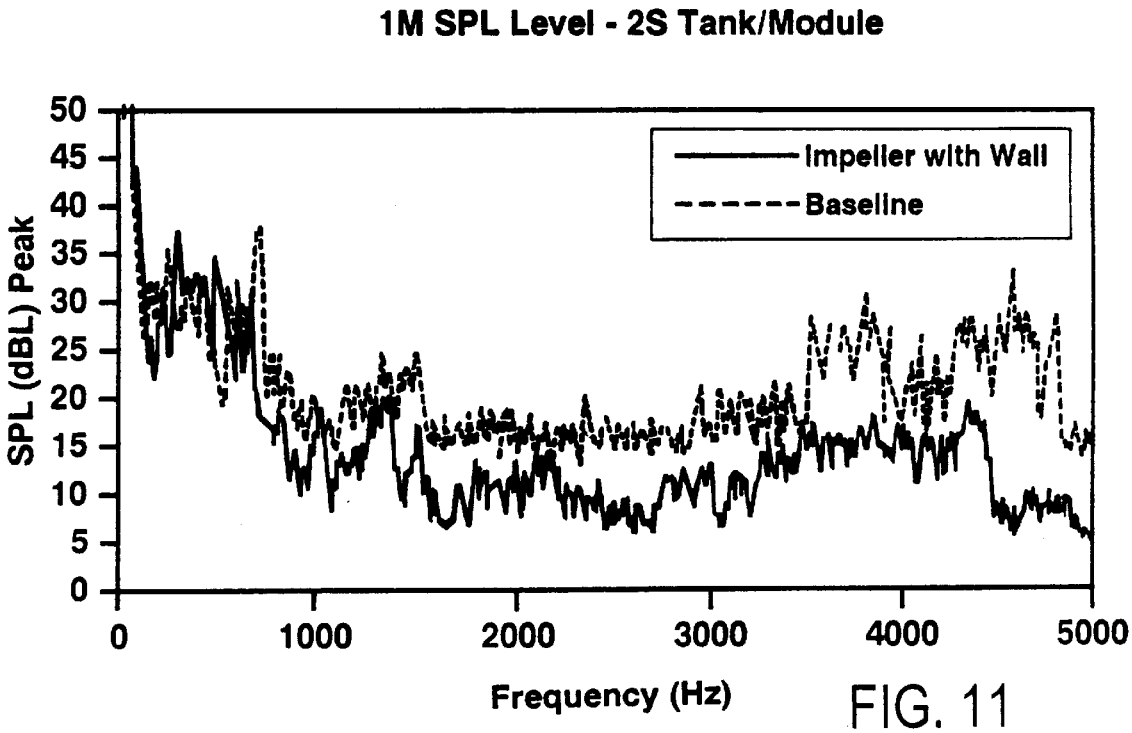
FIG. 10 is a comparison table of flow rate, hydraulic torque, and hydraulic efficiency in a staggered vane type impeller and an impeller according to a preferred embodiment of the present invention.
FIG. 11 is a graph illustrative of frequency characteristics for explaining noise-preventing effect of the preferred embodiment versus a baseline impeller.

Referring now to FIG. 10, a tabular representation of the improvements in flow rate, hydraulic torque, and hydraulic efficiency of the preferred embodiment versus a typical staggered vane type impeller as shown in FIG. 9 is shown. In FIG. 10, flow rates, hydraulic torque, and hydraulic efficiency of the preferred embodiment of the impeller and prior art impeller of FIG. 9 were measured at two different pressures/speed settings (200 KPa and 4000 rpm; 284 KPa and 5500 rpm). At the lower setting (200 KPa and 4000 rpm), the flow rate increased from 34.1 to 39.0 LPH, the hydraulic torque decreased form 0.0219 to 0.0212 NM, and the hydraulic efficiency increased from 20.7% to 24.4%. At the higher setting (284 KPa and 5500 rpm), the flow rate increased from 66.6 to 76.3 LPH, the hydraulic torque decreased from 0.0332 to 0.0324 NM, and the hydraulic efficiency increased from 27.5% to 32.3%. Thus, the table indicates that an impeller according to the preferred embodiment shows improvements in flow rate, hydraulic torque, and hydraulic efficiency versus a typical staggered type impeller at both lower and higher pressure/speed settings.

Turning now to FIG. 11, a graphic representation of noise levels at various frequencies is shown. As the graph indicates, the impeller according to the preferred embodiment shows marked decreases in noise levels compared to a baseline impeller at virtually all speeds from 0 rpm to 5000 rpm. Noises were measured by placing the impellers in a test vehicle.

While the invention has been described in terms of preferred embodiments, it will be understood, of course, that the invention is not limited thereto since modifications may be made by those skilled in the art, particularly in light of the foregoing teachings.

What is claimed is:

1. A regenerative pump comprising:

a housing with a pump inlet and a pump outlet; and an impeller rotatably mounted within said housing, said impeller having a central hub centered on a rotational axis of said impeller, said central hub having a plurality of vanes extending radially from said central hub, said plurality of vanes spaced uniformly around said central hub, wherein each of said plurality of vanes is coupled to an adjacent vane by a rib, and wherein each of said plurality of vanes has a vane groove having a first height and a length, a cover-side vane tooth extending from said vane groove having a second height, and a body-side vane tooth extending from said vane groove having a third height, wherein said cover-side vane tooth and said body-side vane tooth have a phase difference with respect to one another and wherein said vane groove runs substantially parallel to said rib.

2. The regenerative pump of claim 1, wherein said first height of said vane groove is equal to said second height of said cover-side vane tooth and is equal to said third height of said body-side vane tooth.

3. The regenerative pump of claim 1, wherein said second height of said cover-side vane tooth is equal to said third height of said body-side vane tooth.

4. The regenerative pump of claim 1, wherein said phase difference is a function of said length of said vane groove.

5. The regenerative pump of claim 1, wherein said rib has a fourth height, said fourth height being approximately 60% of said first height of said vane groove.

6. The regenerative pump of claim 1, wherein said rib has a fourth length and a rib height, said fourth length varying as a function of said first length and said rib height.

7. An impeller for use in a rotary machine comprising:

a central hub having a geometric center;

a plurality of vanes extending radially from said central hub;

each of said plurality of vanes having a vane groove having a first height, a body-side vane tooth extending from said vane groove having a second height, and a cover-side vane tooth extending from said vane groove having a third height, wherein said cover-side vane tooth and said body-side vane tooth have a phase difference with respect to one another; and a rib coupled to said plurality of vanes and running substantially parallel to said vane groove.

8. The impeller of claim 7, wherein said first height of said vane groove is equal to said second height of said body-side vane tooth and said third height of said cover-side vane tooth.

9. The impeller of claim 7, wherein said said second height of said body-side vane tooth is equal to said third height of said cover-side vane tooth.

10. The impeller of claim 7, wherein said phase difference is a function of said length of said vane groove.

11. The impeller of claim 7, wherein said rib has a fourth height, said fourth height being approximately 60% of said first height of said vane groove.

12. The impeller of claim 7, wherein said rib has a fourth length and a rib height, said fourth length varying as a function of said first length and said rib height.

13. A regenerative pump comprising:

a housing with a pump inlet and a pump outlet; and an impeller rotatably mounted within said housing, said impeller having a central hub centered on a rotational axis of said impeller, said central hub having a plurality of vanes extending radially from said central hub, each of said plurality of vanes being coupled to said adjacent vane by a rib, and wherein each of said plurality of vanes has a vane groove having a first height and a length, a cover-side vane tooth extending from said vane groove having a second height, and a body-side vane tooth extending from said vane groove having a third height, wherein said cover-side vane tooth and said body-side vane tooth have a phase difference with respect to one another and wherein said vane groove runs substantially parallel to said rib.

14. The regenerative pump of claim 13, wherein said plurality of vanes is spaced uniformly around said central hub.

15. The regenerative pump of claim 13, wherein said first height of said vane groove is equal to said second height of said cover-side vane tooth and said third height of said body-side vane tooth.

16. The regenerative pump of claim 13, wherein said second height of said cover-side vane tooth is equal to said third height of said body-side vane tooth.

17. The regenerative pump of claim 13, wherein said phase difference is a function of said length of said vane groove.

18. The regenerative pump of claim 13, wherein said rib has a fourth height, said fourth height being approximately 60% of said first height of said vane groove.

19. The regenerative pump of claim 13, wherein said rib has a fourth length and a rib height, said fourth length varying as a function of said first length and said rib height.

* * * * *